US006235245B1

(12) United States Patent
Sherman et al.

(10) Patent No.: US 6,235,245 B1
(45) Date of Patent: May 22, 2001

(54) DEVICE FOR MIXING, RESUSPENDING, HOMOGENIZING AND AERATION OF SUBSTANCES IN TEST TUBES

(76) Inventors: Michael Sherman, 581 Saw Mill Brook Pkwy., Newton, MA (US) 02459; Yury Sherman, 511 Beech St., Roslindale, MA (US) 02131; Katerina Sherman, 77 Baker St., Boston, MA (US) 02132

( * ) Notice: Subject to any disclaimer, the term of this patent is extended or adjusted under 35 U.S.C. 154(b) by 0 days.

(21) Appl. No.: 09/322,298

(22) Filed: May 28, 1999

Related U.S. Application Data

(60) Provisional application No. 60/109,440, filed on Nov. 23, 1998.

(51) Int. Cl.[7] ..... B01F 9/10; B01L 3/14

(52) U.S. Cl. ..... 422/102; 366/200; 366/213; 366/219; 494/16; 494/31; 494/84

(58) Field of Search ..... 422/72, 101, 102; 494/16, 31, 33, 84; 366/200, 213, 219

(56) References Cited

U.S. PATENT DOCUMENTS 5,665,047 * 9/1997 Brimhall ..... 494/16

* cited by examiner

*Primary Examiner*—David A. Reifsnyder
(74) *Attorney, Agent, or Firm*—John Hungtington Croziez

(57) ABSTRACT

A multi-purpose device, the device including a tube holder for holding tubes; tube driving apparatus for rotating the tubes in the tube holder, the tube holder having spaces for accommodating the tubes such that each one of the tubes can be placed in a separate one of the spaces; the spaces having shapes and sizes providing free rotation of the tubes within the spaces about longitudinal axes of the tubes; the tube driving apparatus having touching engagement with walls of the tubes and pressing the walls of the tubes against the tube holder; and friction between the tube driving apparatus and the walls of the tubes being greater then friction between walls of the tubes and the tube holder.

6 Claims, 5 Drawing Sheets

DEVICE FOR MIXING, RESUSPENDING, HOMOGENIZING AND AERATION OF SUBSTANCES IN TEST TUBES

This application dains benefit of provisional application No. 60/109,440 filed Nov. 23, 1998.

BACKGROUND OF THE INVENTION

Mixing, aeration, resuspending, and homogenizing of substances, cells and particles contained in test tubes are regularly used in biological, medical, chemical and similar types of research procedures including growing bacterial, yeast and tissue cultures, DNA mini-prep preparation, nuclear extract preparation, membrane blotting, etc.

Different types of devices - mixers, shakers, test tube rollers, etc.—are used for the above purposes. Different principles of treatment of substances are employed in these devices. For example, combination of vibrating and spinning of the tubes is usually used for vigorous mixing of substances. Shaking of substances is provided by seesaw motion or gentle rotation of the tubes. For aeration slow rotation of the tubes inside a tube bolder is used.

As the main drawbacks of the existing technology it is noted that the devices are complicated an expensive, applicable only for very specific processes, a lot of precious laboratory space is required for installation of a set of necessary devices.

SUMMARY OF THE INVENTION

Accordingly, the object of the present invention is a multi-purpose device for mixing, aeration, rending, and homogenizing of substance, cells and particles contained in test tubes. The device is applicable for growing bacterial, yeast and tissue cue, nuclear extract preparation from tissue cues, membrane blotting, mini-prep preparation, etc. All these procedures are accomplished by rotation of test tubes at variable speed depending on required intensity of mixing/stirring of substances.

The device consists of three main parts: a tube holder, a tube driver rotating thetubes contained in the tube holder and a base supporting the holder and the tube driver.

The holder includes two tube holding elements forming a drum-like structure which has a number of registered holes the tubes are contained in. The holes are placed such that the tubes are equidistant to an axis of rotation of the tube driver. Diameters of the holes are larger than diameters of the tubes so that the tubes can be freely rotated about their longitudinal axes The tubes are supported by the tube holder or hung from the holder The tube holder can be tilted, or rotated about at least on of its axes, or installed stationary. There are means for fixing the tilted position of the holder. The tube driver includes an electric motor and a tube rotator which is a rigid element attached to and coaxial with a shaft of the electric motor The rotator has a replaceable rim(s) faced toward the tubes and in touching engagements with walls of the tubes. The rim(s) is made of a soft and resilient material so that when it contacts with the tubes the contacting surfaces of the rim(s) become impressed and like the tubes' shape. Due to the friction between the tube walls and the rim(s) must be greater than the friction between the tube walls and the tube holder couple of the rim's material and the tubes' material must be higher tan that of the tubes' material and the tube holder's material As a result, when the tube rotator is rotated, the rim(s) slide by the tubes. The induced friction forces between the rim and the tubes are higher than friction forces of opposite direction between the tubes and the tube holder. Due to this, rotation of the tube rotator induces rotation of the tubes. The tubes can be rotated in one direction (clockwise or counter clockwise) or in alternative directions (clockwise and counter clockwise).

A material of the outer surfaces of the rims is of high wearing resistance. The tube rotator or the rim(s) are replaceable.

DESCRIPTION OF THE PREFERRED EMBODIMENT

Figure 1:
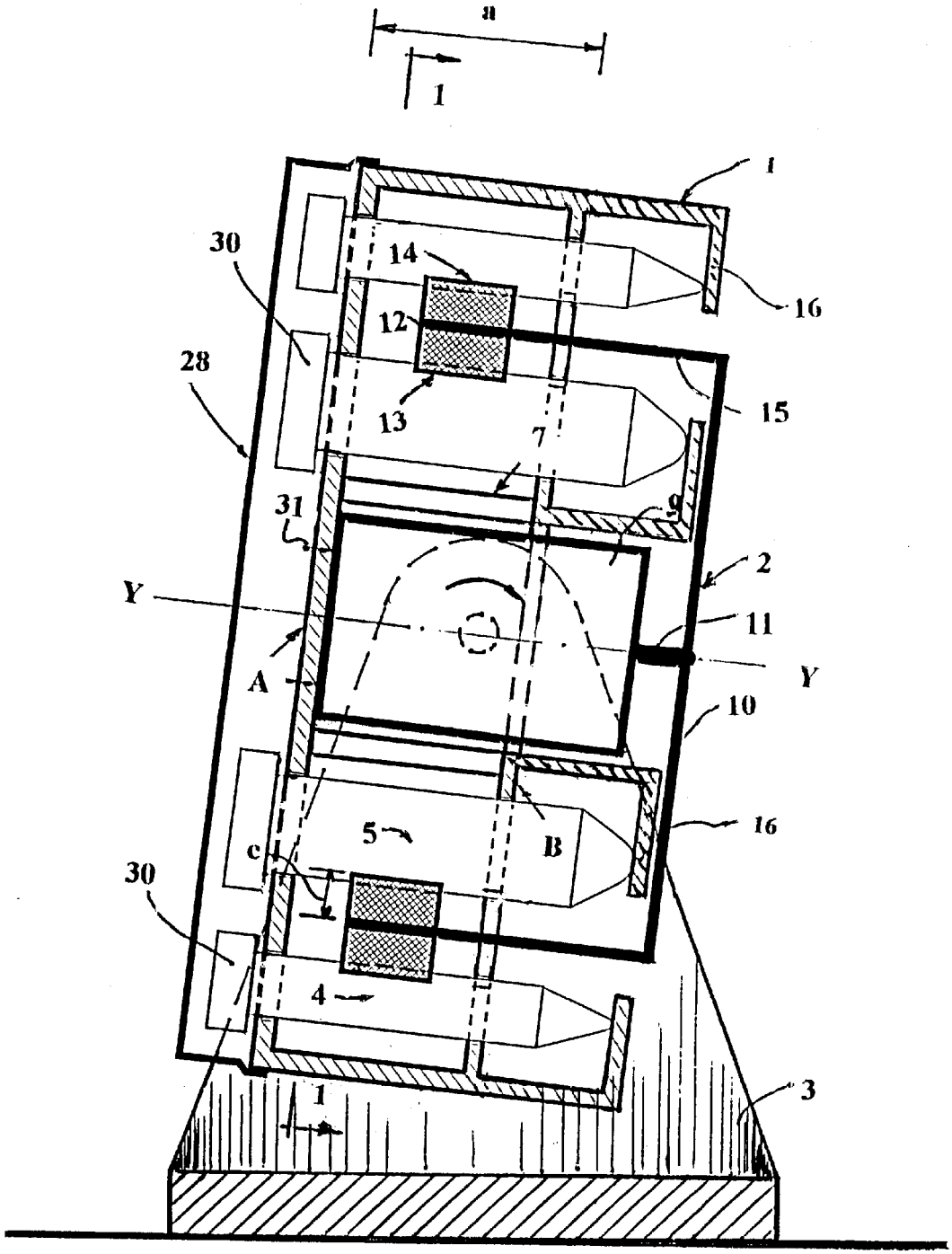
FIG. 1 is a cross section of a device.

Referring to the drawings in more detail, in FIG. 1 a cross section of the device for processing of 24 test tubes of 15 ml (4) plus 8 test tubes of 50 ml (5) is shown. The device is intended for mixing, aeration, resuspending, and homogenizing of substances, cells and particles in test tubes.

The device consists of three main parts: a tube holder 1, a tube driver 2 rotating the tubes contained in the tube holder and a base 3 supporting the holder and the tube driver.

The holder 1 includes two tube holding elements A and B (FIGS. 1, 2 and 3) forming a drum-like structure. Spacers 7 between the elements A and B are affixed to the element A and used as supports for the element B.

The tube holder has a number of registered holes the tubes pass through: holes 6 for test tubes 15 ml (4) in the element A, the holes 6' for test tubes 50 ml (5) in the elements A and B. The holes are placed such that the tubes are equidistant to an axis Y—Y of rotation of the tube driver.

Diameters of the holes are larger than diameters of the tubes so that the tubes contained in the holder can be freely rotated about their longitudinal axes. Space "b" between the elements A and B (FIG. 3) is necessary for inserting the elements 13,14,15 of the tube driver 2 inside the tube holder, as it is shown in FIG. 1. Size "a" (FIG. 1) of the tube holder is less than length of the tubes. Thereby when the tubes receive lateral pressure from the tube driver they become pressed against both A and B elements. The elements A and B have cantilevers 16 supporting the tubes at their bottom ends.

Figure 2:
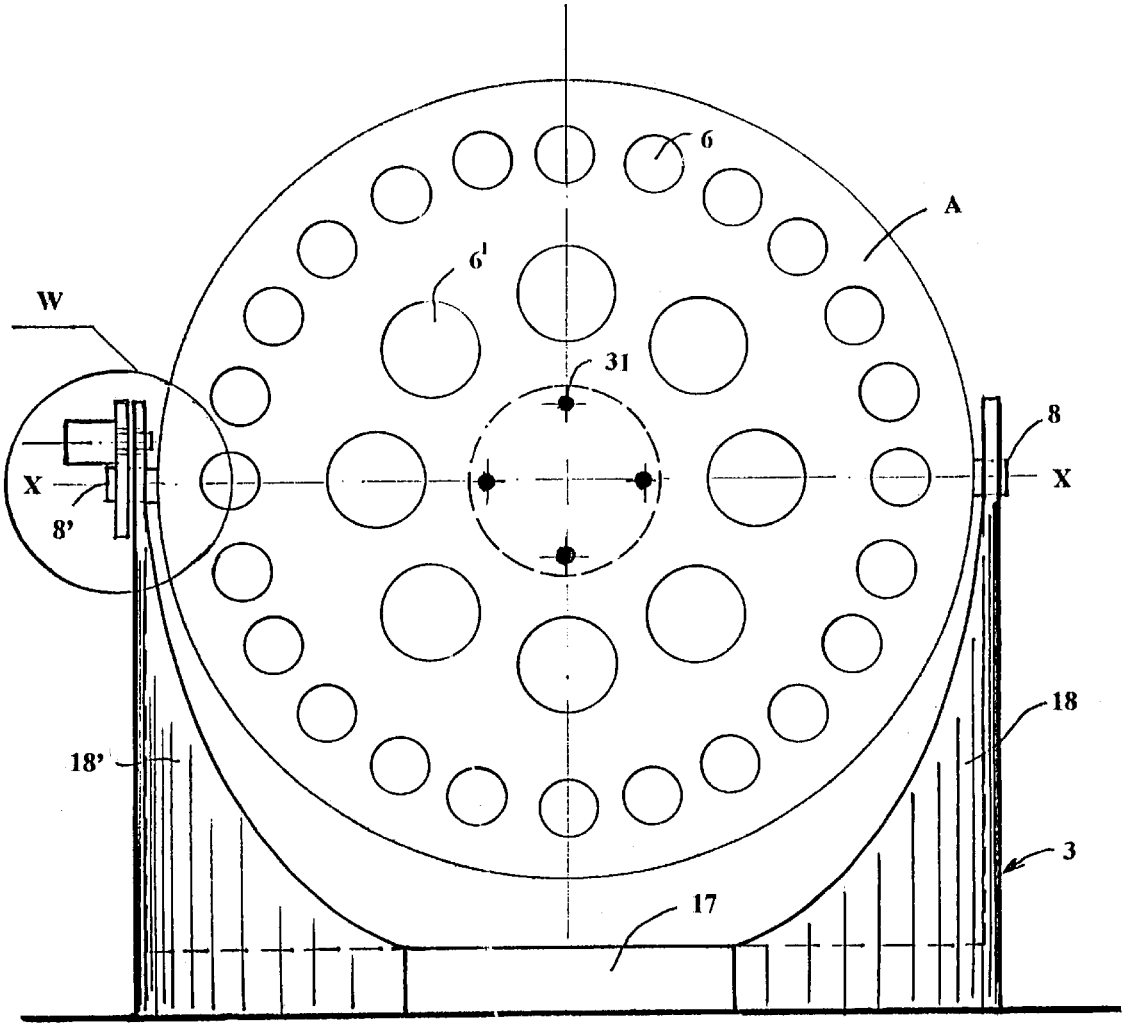
FIG. 2 is a front view of the device (test tubes are not shown).
Figure 3:
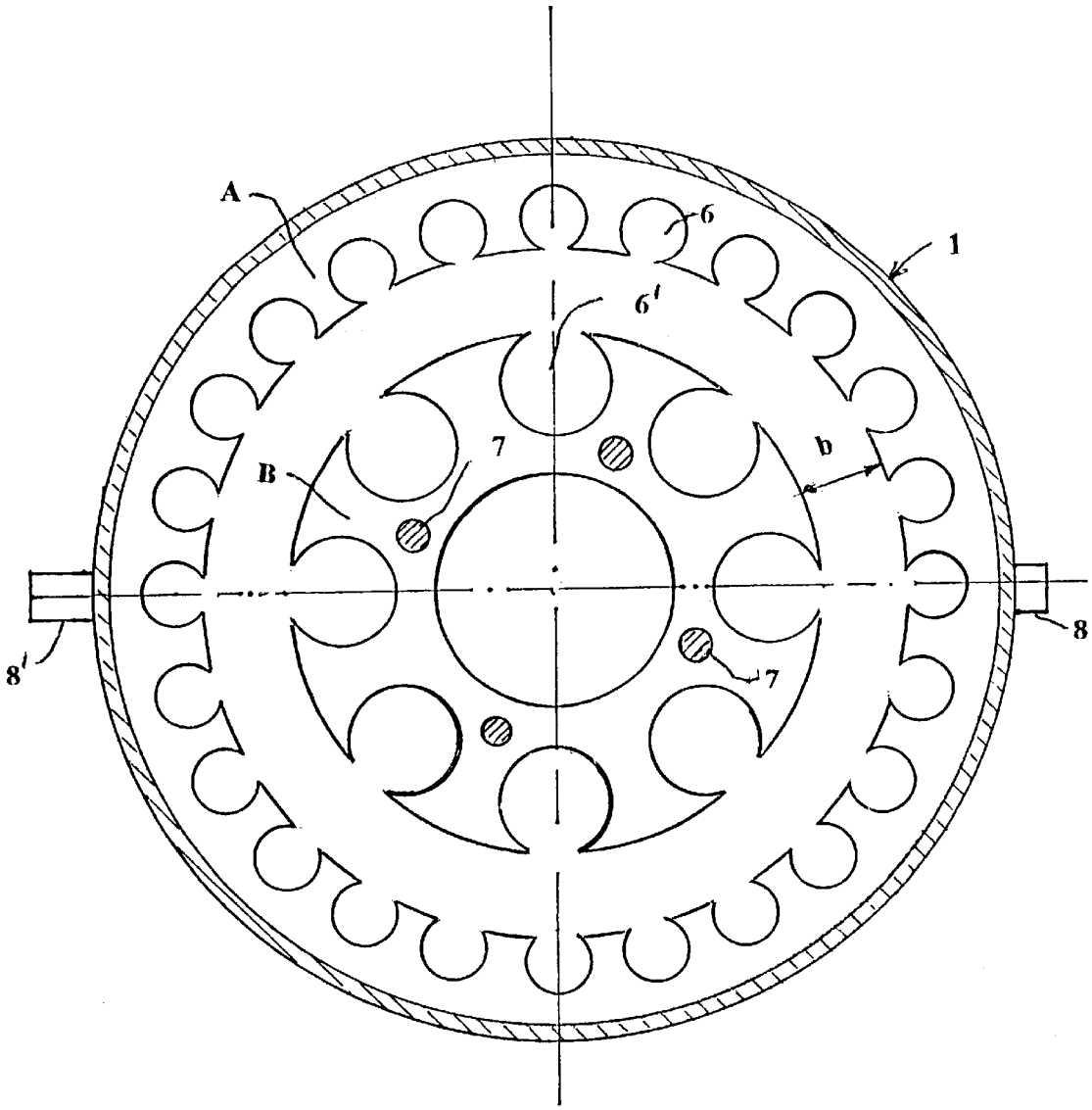
FIG. 3 is a cross section of a device in FIG. 1 along 1—1 (test tubes, tube driver and support of the device are not shown).

In line with axis X—X of the tube holder there are two pivots 8 and 8' (FIG. 2). The pivots are intended for tilting/rotating of the holder. The axis X—X is placed close to the gravity center of the tube holder loaded with the tubes and the tube driver 2 as a whole nit. It provides ease tilting of the tube holder or its rotating without significant dynamic loads.

To reduce friction forces between the rotated tube and the walls of the holes the the materials of which the walls of the holes and the tubes are made should be such that low friction forces exist therebetween. If necessary, surfaces of the tube holder contacting with the tubes can be specially treated for filer reduction of the friction forces.

The tube driver 2 consists of an electric motor 9 and a replaceable cuplike tube rotator 10 attached to the motor shaft 1 (FIG. 1). The motor is affixed to the element A of the tube holder by studs 31 (FIG. 1). The axis of rotation of the motor shaft Y—Y and the axis of the tube holder perpendicular to the elements A and B are coincident.

Close to the edge 12 of a tube rotator's wall 15 there are two replaceable rims 13 and 14 faced toward the tubes 4 and 5. As it is shown in FIG. 1, outer surfaces of the rims slightly overlap the tubes' walls that provides their touching engagements with walls of the tubes. The rims are made of a soft and resilient meal so that when they contact with the tubes the contacting surfaces become impressed and take the tubes' shape. Due to this resilient deformations the tubes receive gentle lateral pressure against the tube the friction between the rims and the walls of the tubes must be greater than the friction between the walls of the tubes and the tube holder.

A material of the outer surfaces of the rims should be of high wearing resistance.

The base 3 consists of a supporting plate 17 and walls 18 and 18'. The walls include means providing hinge joint of the tube holder's pivots 8 and 8+.

Figure 4:
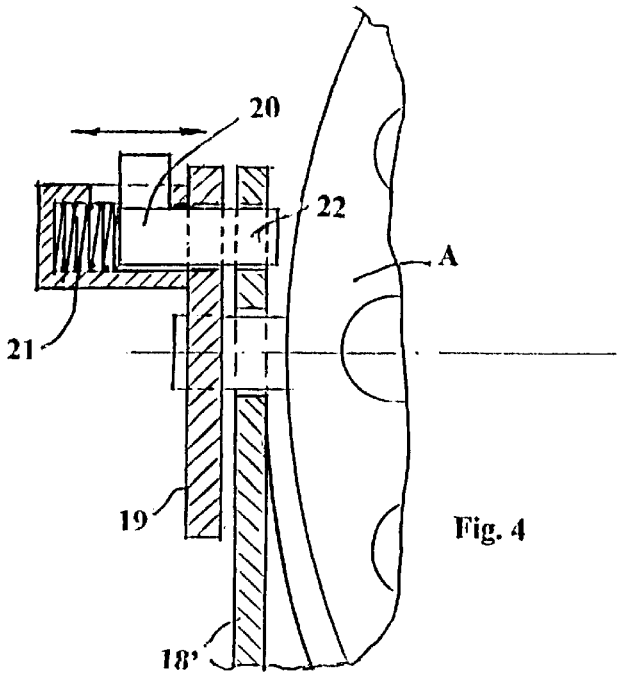
FIG. 4 is an enlarged fragment "W" of a device in FIG. 2.

Different methods of treatment of substances in the tubes require controllable tilting of the tube holder. For example, during vigorous mixing substances or strong aeration of cultures the tubes should be positioned vertically. In contrast, during gentle mixing of substances and their aeration the tubes should be positioned almost horizontally. The device includes a means for fixing such positions (FIG. 4). This is a catch consisting of a plate 19 affixed to the pivot 8' and a moveable pin 20 pushed outside by a spring 21. There are several holes 22 in the wall 18' that match required positions of the holder. Tilting of the tube holder tuns the pivot 8' and the catch. When the pin 20 register appropriate hole 22 it jumps into the hole that fixes a required position of the tube holder.

Operation

During rotation of the tube rotator the rims slide by the tubes. Due to noted correlation between friction of the rims/tubes and the tubes/tube holder, the induced friction forces between the rims and the tubes are higher than friction forces of opposite direction between the tubes and the tube holder. Thereby, rotation of the tube rotator rotates the tubes inside the holes of the tube holder. The tubes can be rotated in one direction (clockwise or counter clockwise) or in alternative directions (clockwise and counter clockwise).

Speed of rotation of the tubes depends on speed of the electric motor and correlation between diameters of the tube rotator and the tubes. In case of the device shown in FIG. 1, this ratio is approx 1:10. It provides a high-speed rotation of the tubes and, accordingly, a very effective mixing of substances by using regular low-speed electric motor. If the rims a wear out or damaged it is possible to replace them or the whole tube rotator.

Figure 5:
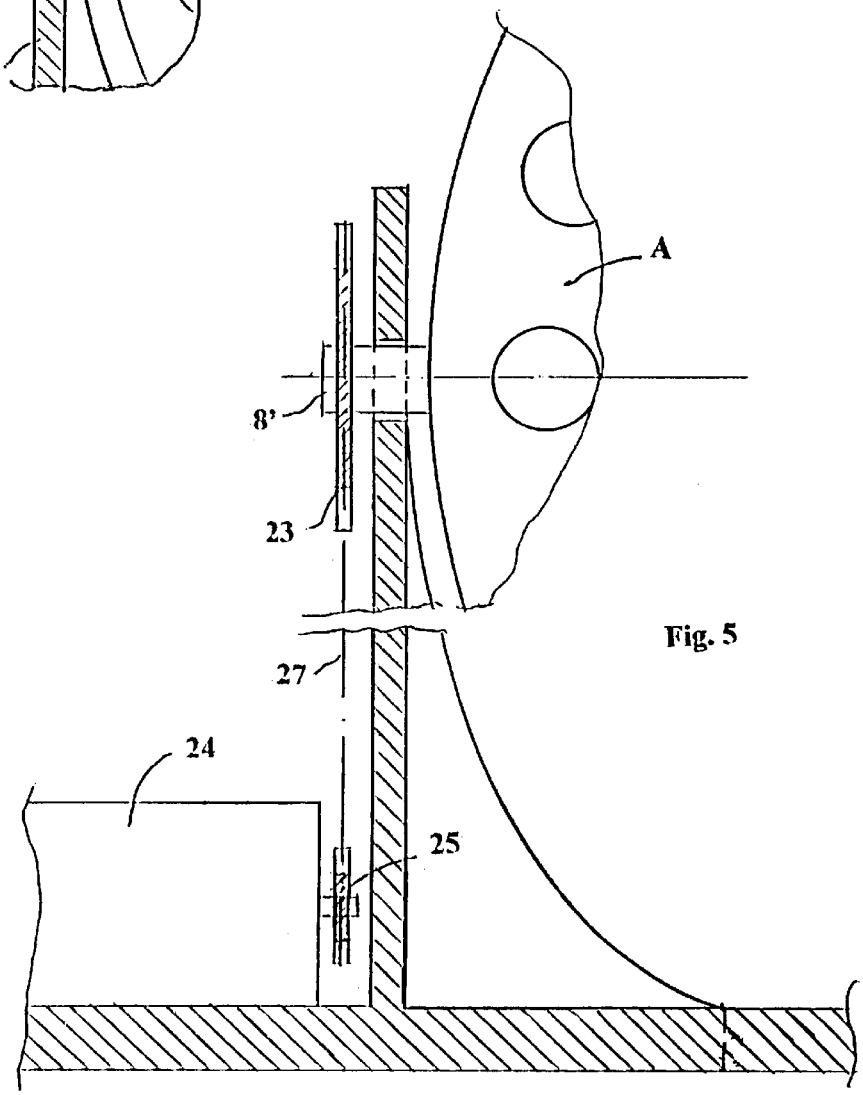
FIG. 5 is a fragment of the device showing means for rotation of a tube holder about its axis.

In some cases effectiveness of the device can be increased if the tubes are subjected to complex rotations about their longitudinal axes and in vertical plane (about axis X—X of the tube holder, FIG. 2). This rotation is provided in the second version of the invention. For this purpose a special tube driver rotating the tube holder (FIG. 5) substitutes the catch shown in the first version of this invention (FIG. 4). The tube driver includes an electric motor 24 with sprocket 25 affixed to its shaft, a sprocket 23 affixed to the pivot 8' and a chain 27 connecting the sprockets. Rotation of the electric motor's shaft rotates the tube holder. It is evident, that such a rotation can be provided by different mechanisms. A cap 28 (FIG. 1) is used to avoid sliding out of the tubes from the tube holder when the tubes are tuned upside-down.

Figure 6:
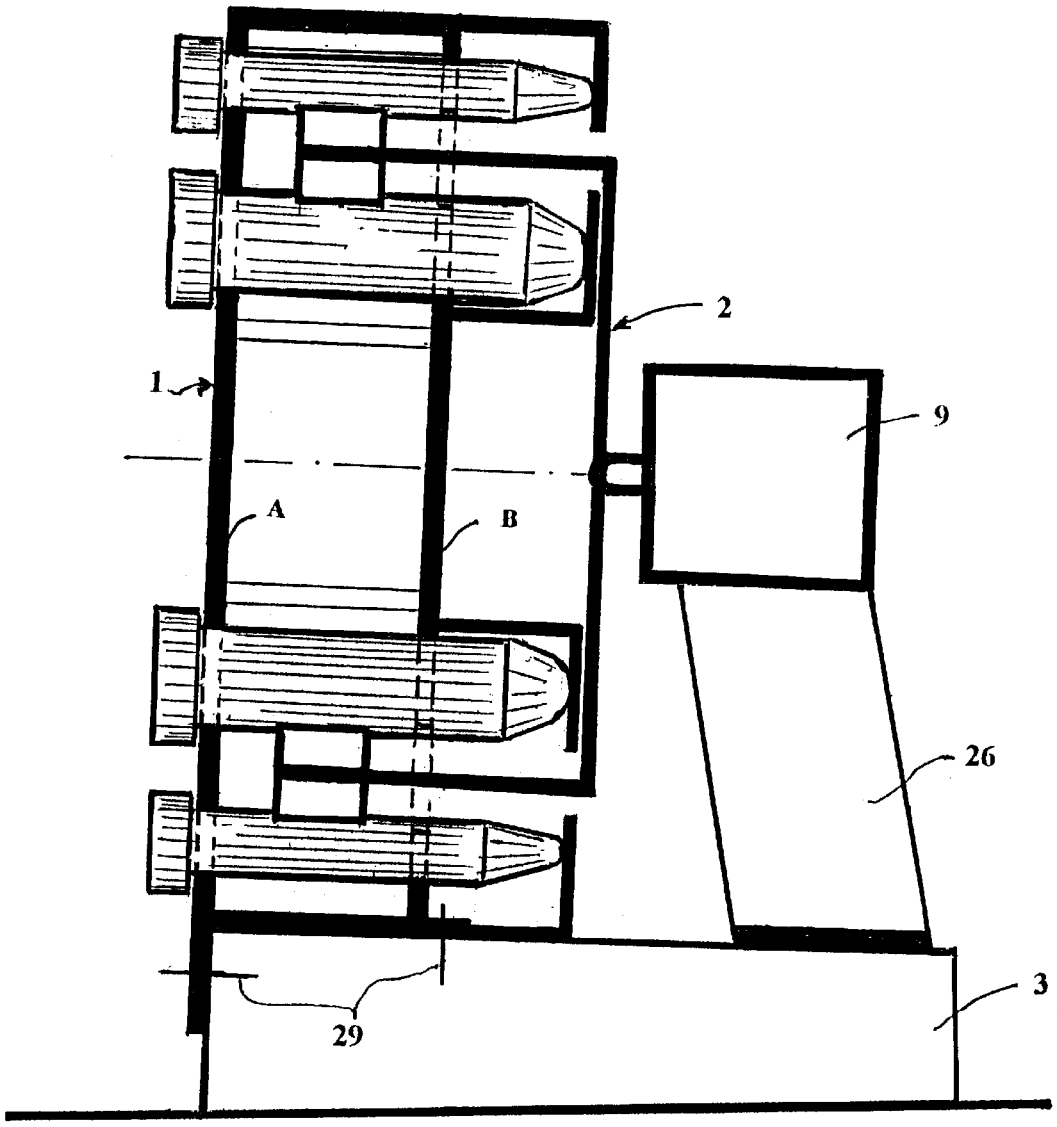
FIG. 6 is a device with replaceable tube holder

In some cases it is desirable to have a replaceable tube holder. The third version of this invention meets this condition As it is shown in FIG. 6, in contrast to the version shown in FIG. 1, the electric motor 9 is affixed to the extension 26 of the base. The tube holder is rigidly affixed to the base by screws 29. Thereby the tube holder can be easily detached from the base and replaced. In this case position of the tube holder in vertical plane becomes stationary.

This invention is not limited to the details shown since various modifications and structural changes are possible without departing in any way from the spirit of the present invention What is desired to be protected is set forth in particular in the appended claims.

What is claimed is:

1. A multi-purpose device for the processing of substances, cells and particles contained in tubes, such as mixing, aeration, resuspension and homogenizing, the processing being accomplished by rotation of said tubes, said device comprising:

(a) a tube holder for holding said tubes;

(b) tube driving means for rotating said tubes in said tube holder;

(c) said tube holder having spaces for accommodating said tubes such that each one of said tubes can be placed in a separate one of said spaces;

(d) said spaces having shapes and sizes providing free rotation of said tubes within said spaces about longitudinal axes of said tubes;

(e) said tube driving means having touching engagement with walls of said tubes and pressing said walls of said tubes against said tube holder; and (f) friction between said tube driving means and said walls of said tubes being greater than friction between said walls of said tubes and said tube holder.

2. A device according to claim 1, wherein: said tube holder is stationary.

3. A device according to claim 1, wherein: said tube holder can be tilted about its horizontal axis.

4. A device according to claim 3, wherein: means are provided for fixing a tilted position of said tube holder.

5. A device according to claim 1, wherein: said tube holder can be rotated about its longitudinal axis.

6. A device according to claim 1, wherein: said tube holder is replaceable.

* * * * *